United States Patent [19]

Lindstrom

[11] 4,097,952

[45] Jul. 4, 1978

[54] MOPS OF CELLULOSE SPONGE CLOTH MATERIAL

[76] Inventor: Robert J. Lindstrom, 400-410 W. 2nd. St., Sedalia, Mo. 65301

[21] Appl. No.: 790,404

[22] Filed: Apr. 25, 1977

[51] Int. Cl.[2] ..... A47L 13/16; A47L 13/20

[52] U.S. Cl. ..... 15/244 R; 15/229 R

[58] Field of Search ..... 15/147, 187, 223, 225, 15/226, 228, 229, 244 R, 244 B, 244 C; 401/289; 428/311

[56] References Cited

U.S. PATENT DOCUMENTS

| | | | |
|---|---|---|---|
| 1,993,215 | 3/1935 | Hoyt et al. | 15/226 UX |
| 2,320,372 | 6/1943 | McCarthy | 15/229 BC |
| 2,514,496 | 7/1950 | Jones et al. | 15/223 |
| 2,595,776 | 5/1952 | Downey | 15/225 X |
| 2,600,143 | 6/1952 | Vaughn | 15/229 UX |
| 3,068,505 | 12/1962 | Lindstrom | 15/229 R |
| 3,068,545 | 12/1962 | Stiner | 15/244 B X |
| 3,827,099 | 8/1974 | Allaire et al. | 15/229 R |

FOREIGN PATENT DOCUMENTS

| | | | |
|---|---|---|---|
| 763,988 | 2/1934 | France | 15/244 B |
| 162,946 | 9/1933 | Switzerland | 15/229 A |
| 736,847 | 9/1955 | United Kingdom | 15/229 AP |

*Primary Examiner*—Daniel Blum

*Attorney, Agent, or Firm*—Fishburn, Gold & Litman

[57] ABSTRACT

A mop is comprised of several thin rectangular layers of cellulose sponge cloth cut longitudinally into long strips, retaining an uncut undulated center section which is attached to a mop handle to form the completed assembly. The strips tend to lie flat on the floor during use, increasing cleaning efficiency.

7 Claims, 6 Drawing Figures

MOPS OF CELLULOSE SPONGE CLOTH MATERIAL

This invention relates to a novel mop head made from highly absorbent strips of cloth-like material.

Mops are well-known as cleaning and scrubbing water-absorbent implements. The usual type of mop employs a handle connected to a mop head which is composed of numerous strands of fibrous absorbent material such as cotton. Cotton or similar fibers when suitably spun into long cylindrical strands have certain attributes which have made them popular for use in mops, namely; ready availability for manufacture, strong relative strength, and a capability to absorb fluids. However, cotton and similar fibers have disadvantages, including; relatively high expense, the tendency to leave lint or broken strands behind on newly cleaned surfaces, a relatively small surface contact area during use and the likelihood to turn sour and foul-smelling unless washed frequently with strong disinfectants. Cotton mops have usually been made by passing numerous individual strands through the center of the mop head and clamping the strands in the middle so they double back over the clamp and depend therefrom. By this construction, an individual strand may, at times, pull out of the head, causing annoyance to the user and loosening the other strands whereby the remaining strands pull out and the mop becomes useless.

The present invention seeks to overcome the above difficulties and comprises a novelly designed mop head comprised of thin, flat strips of highly absorbent cloth-like material. The strips are combined together so that they cannot pull out of the head and are composed of a material which does not have the disadvantages of cylindrical cotton or similar fiber strands, as described above.

Various brushes intended for use as disposable whisks are known and are exemplified by U.S. Pat. Nos. 1,927,730 and 2,595,776. These generally consist of non-absorbent resilient strips cut inwardly from the ends of a rectangular sheet of paper and retain an uncut center section which may be rolled for use as a handle or to attach onto a handle. These references are not related to mops or the use thereof.

The principal object of this invention is to provide an improved mop having high water absorbent characteristics without the disadvantages of conventional cotton mops.

Another object of the invention is to provide a lower having absorbent strips able to better withstand rough handling during scrubbing and scouring operations while exhibiting superior cleaning characteristics.

Yet another object of the invention is to provide a plurality having absorbent strips not individually separable from the head without tearing.

A further object of the invention is to provide a mop economical to manufacture, strudy and efficient in use, and particularly well adapted for its intended purpose.

Other objects and advantages of this invention will become apparent from the following description taken in connection with the accompanying drawings wherein are set forth, by way of illustration and example, certain embodiments of this invention.

Figure 1:
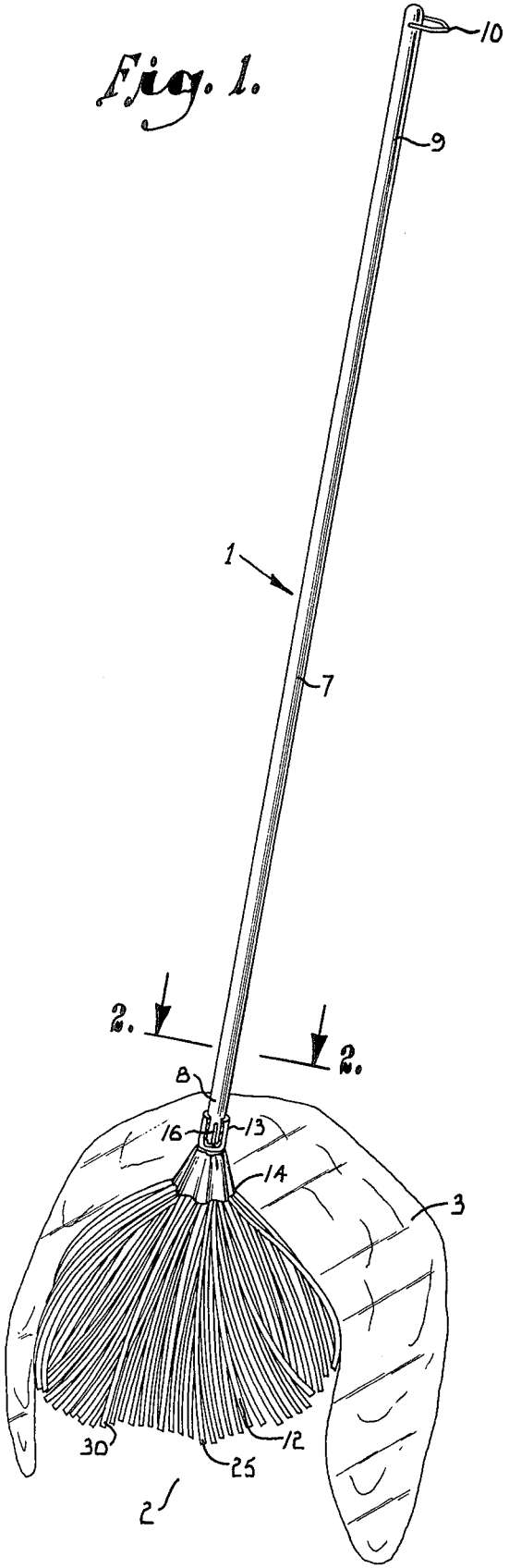
FIG. 1 is a perspective view of the mop in use on a wet floor.
Figure 2:
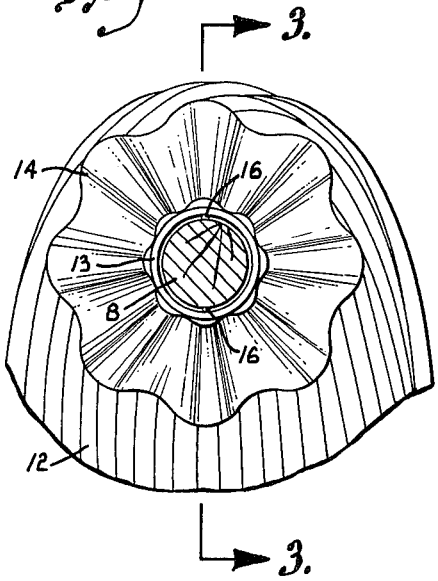
FIG. 2 is an enlarged, fragmentary, cross-sectional view of the mop taken along lines 2—2, FIG. 1.

Referring to the drawings in more detail:

FIG. 1 depicts a mop, generally designated by the reference numeral 1, in use scrubbing a floor 2 and absorbing cleaning water or other liquid 3 theron. The mop 1 is comprised of a conventional elongated handle 7 having a lower end 8 and an upper end 9 with a ring 10 extending therethrough to suspend the mop 1 for storage. A mop head 12 is mounted to the lower end 8 by any suitable means, in this example including a staple 16 extending through or around the mop head 12 and engaging the handle lower end 8, FIG. 3. The staple 16 is preferrably concealed by an attractive cover 13, here in the shape of an inverted cone having a downwardly and outwardly directed flared and fluted circumference 14 similarly directing the mop head 12, FIGS. 1 and 3.

Figure 4:
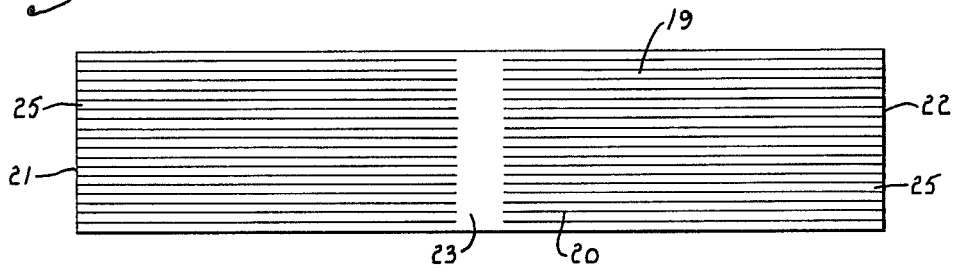
FIG. 4 is a top plan view of a sheet of mop-forming cloth with cut strips on opposite ends.

The mop head 12 includes several layers 20 of absorbent cloth 19, FIG. 4. The layer 20 is a thin, rectangular portion of highly absorbent cloth sufficiently strong to withstansd vigorous scrubbing and scouring activities. A thin cellulose sponge cloth is preferred as it has excellent absorbent characteristics combined with adequate tensile strength. Cellulose cloth, unlike cotton fibers used in many conventional mops, is a clean, sanitary material not as likely to leave lint or bits of broken fiber in its path. Nor is cellulose cloth as likely to provide a good medium for growth of bacteria and fungi which cause sour and unpleasant odors common in damp cotton mops. Further, the cellulose cloth used has a relatively tough, yet absorbent, flat, outer skin on both the upper and lower surfaces blending into a less compact, but even more absorbent, felt-like inner filling. Upon contact with a wet surface, the flat skin acts like a chamois, rapidly soaking up moisture and tightly adhering to the mopped surface over a relatively great area compared to a cylindrical string, producing efficient cleaning and liquid removal.

Referring to FIG. 4, the rectangular cloth layer 20 has opposing ends 21 and 22. Narrow strips 25 are cut inwardly and longitudinally from the ends 21 and 22, retaining a transverse uncut center section 23 therebetween.

Figure 3:
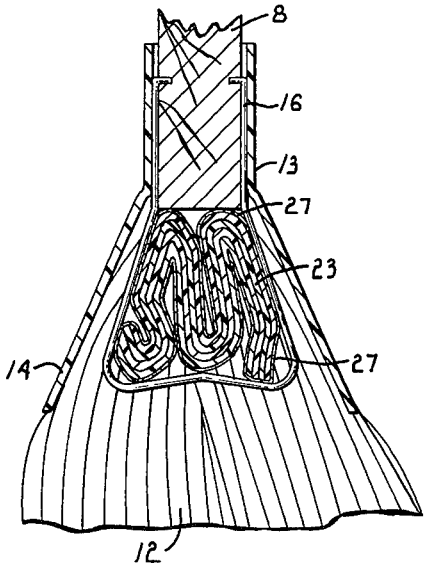
FIG. 3 is an enlarged, fragmentary, cross-sectional view taken along lines 3—3, FIG. 2.
Figure 5:
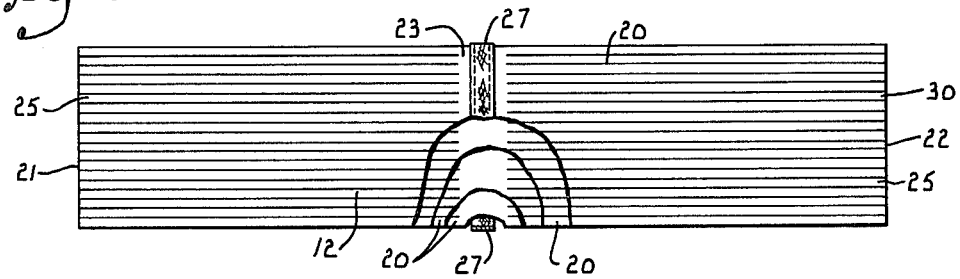
FIG. 5 is a top plan view of several cloth sheets stacked together with portions broken away showing the separate layers.

FIG. 5 illustrates a plurality of layers 20, four in this example, which are superimposed and, if desired, bound together by a band 27 wrapped around and sewn to the superimposed center sections 23 to form the mop head 12, FIG. 1. In attaching the mop head 12 to the handle 7 as described in connection with FIG. 1, the mop head 12, FIG. 3, is gathered transversely or bunched randomly into an undulating pattern such as shown in FIG. 3, forming gathered central sections 23 with opposing ends 21 and 22 directed therefrom. The staple 16 positioned parallel to the center sections 23. It is noted that the band 26 is not necessary with the type of mop utilizing the staple 16 and may be dispensed with, if desired. Further, since the cloth portion of the mop head is essentially integral, there are no individual strands of fiber which may fall out of or be pulled from the mop head 12 without tearing.

Figure 6:
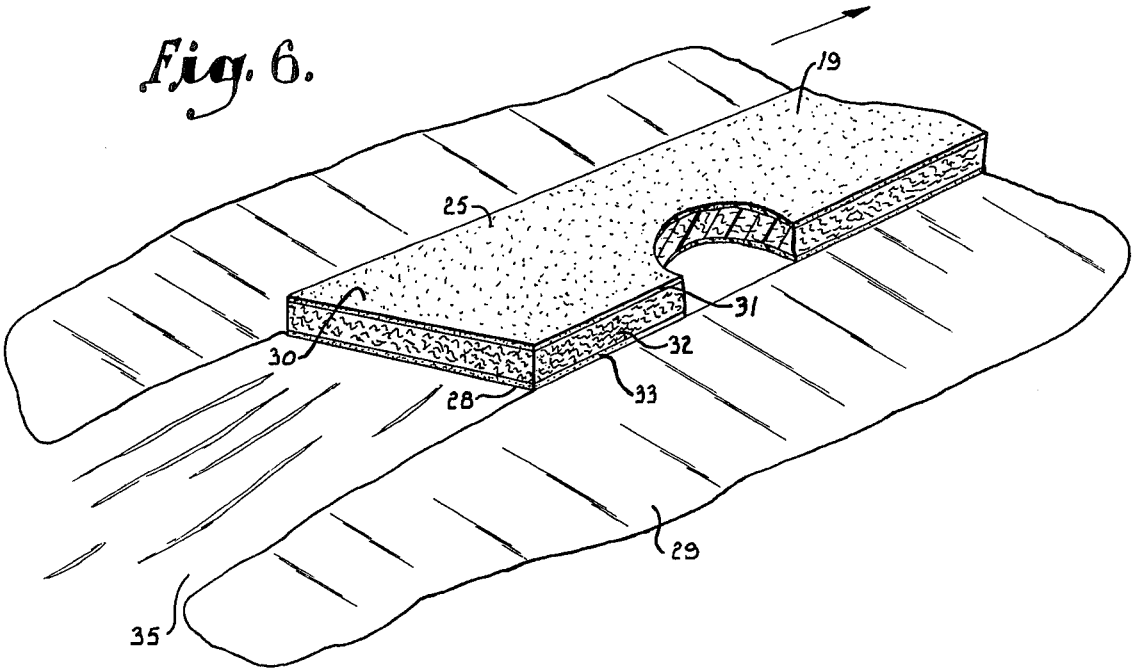
FIG. 6 is a greatly enlarged, fragmentary, perspective view showing a strand drawn across a wet floor.

FIG. 6 illustrates a typical strand 30 of this invention having an elongated rectangular cross-section with flat upper and lower skins 31 and 33 blending into a highly absorbent, felt-like inner filling 32. The skins 31 and 33 provide broad coverage of a wet surface 29 in terms of strand thickness, effectively absorbing moisture 28 therefrom which is communicated by capillary action to the reservoir-like inner filling 32, leaving behind in its path a very thin film of moisture 35 which quickly evaporates.

Referring to FIG. 1, the plurality of strips 25 act as described above when the mop 1 is used. The strips 25 tend to automatically fall flat to the floor 2, providing a large surface contact area for water absorption and scrubbing efficiency.

It is to be understood that while one form of this invention has been illustrated and described, it is not to be limited to the specific form or arrangement of parts herein described and shown, except insofar as such limitations are included in the following claims.

What is claimed and desired to secure by Letter Patent is:

1. A wet mop comprising:

(a) an elongated handle having a lower end;

(b) a mop head having at least one layer of cellulose sponge cloth, said layer being generally rectangular in shape and having opposing end portions, flat strips cut inwardly from said end portions and communicating with an uncut integral central section;

(c) said layer being inwardly gathered along said integral central section in a direction transverse to said strips in such a manner so as to form an indulated gathered central section with said opposing end portions directed therefrom; and (d) connecting means attaching said central section to said loer end with said strips falling downwardly and oriented away from said lower end in an outwardly directed and flared configuration.

2. A mop as in claim 1 wherein a pluralit of said layers are superimposed to comprise said mop head.

3. A mop as in claim 2 wherein there are four of said layers.

4. A mop as in claim 2 wherein said layers are bound together by a band around said center sections and sewn thereto.

5. A mop as in claim 1 wherein said layer is thin.

6. A mop as in claim 1 wherein said connecting means is a staple.

7. A mop as in claim 6 wherein said staple is concealed by an inverted conical cover, said cover having a flared lower circumference directing said mop head downwardly.

* * * * *